US005755594A

United States Patent [19]

Okamura

[11] Patent Number: 5,755,594

[45] Date of Patent: May 26, 1998

[54] CONNECTOR DEVICE

[75] Inventor: Masahiko Okamura, Shizuoka, Japan

[73] Assignee: Yazaki Corporation, Tokyo, Japan

[21] Appl. No.: 712,592

[22] Filed: Sep. 13, 1996

[30] Foreign Application Priority Data

Sep. 14, 1995 [JP] Japan ..... 7-237048

[51] Int. Cl.[6] ..... H01R 13/40

[52] U.S. Cl. ..... 439/598; 439/695

[58] Field of Search ..... 439/598, 595, 439/701, 695

[56] References Cited

U.S. PATENT DOCUMENTS 4,690,478 9/1987 Rahrig et al. ..... 439/595
5,380,220 1/1995 Okabe ..... 439/595
5,618,207 4/1997 Maejima ..... 439/595

FOREIGN PATENT DOCUMENTS 2-278673 11/1990 Japan ..... H01R 13/46

*Primary Examiner*—Neil Abrams
*Assistant Examiner*—T C Patel
*Attorney, Agent, or Firm*—Sughrue, Mion, Zinn, Macpeak & Seas, PLLC

[57] ABSTRACT

An inner plate which can be inserted into a casing, includes a retaining portion which comprises elongate support members, an elastic engagement portion elastically deformable at one ends of the support members, and reinforcement ribs increasing the rigidity of the support members and the elastic engagement portion. A retaining projection for retaining engagement with the elastic engagement portion is formed on the casing.

6 Claims, 3 Drawing Sheets

CONNECTOR DEVICE

BACKGROUND OF THE INVENTION

1. Field of the Invention

This invention relates to a connector device used for connecting wires to their respective mating wires or for connecting wires to various kinds of electronic devices, and more particularly to a connector device in which, when an associated member is inserted into a casing, the biting of wires, as well as damage to the member, is prevented.

2. Description of the Prior Art

Usually, many electronic devices for effecting various kinds of controls are mounted on an automobile, and therefore many connector devices are used for connecting the electronic devices to wire harnesses and for connecting wire harnesses together. Therefore, when severe vibrations are applied, such a connector device is often dislodged out of position, or the contact of terminals, mounted in the connector device, becomes incomplete even though the connector device is not dislodged, which may cause a malfunction of the automobile, such as its inability to travel. Therefore, various devices have been proposed for preventing withdrawal as described below.

FIGS. 5 and 6 show one example of a conventional connector device 41 which basically comprises an inner plate 42 which is integrally molded of a synthetic resin, and is mounted in a casing 43 made of a similar material. The inner plate 42 includes terminal insertion portions 44 for receiving connection terminals 51, respectively, retaining piece portions 45 for positioning the inner plate, projections 46 for positioning the inner plate relative to the casing 43, a pair of withdrawal prevention members 47 (formed at one end of the inner plate 42) each in the form of an elongate plate having a slot 48, and partition walls 49.

For assembling this connector device, the connection terminals 51 are first inserted into the terminal insertion portions 44, respectively, thereby connecting wires 52 to the inner plate. When the inner plate 42 thus assembled is inserted into the casing 43, a retaining projection 53, formed on an inner surface of the casing 43, is engaged in the slots 48 in the withdrawal prevention members 47, thereby retaining the inner plate 42 against withdrawal.

In the connector device 41 of the above construction, however, the withdrawal prevention members 47 are elongate, and the wires 52 are extended along the withdrawal prevention members 47, and therefore there is encountered a problem that when mounting the inner plate into the casing 43, the wires 52 are liable to be bitten.

The withdrawal prevention members 47 are elongate, and besides the slot 48 is formed in each of them, and therefore these members 47 are low in rigidity, and hence are liable to deformation and damage.

Furthermore, whether or not the inner plate 42 is properly mounted is judged by a sense of clicking obtained when the retaining projection 53 becomes engaged in the slot 48. However, since the withdrawal prevention member has a low rigidity, and the lock feeling is so bad that it is difficult to make the judgment properly.

SUMMARY OF THE INVENTION

It is an object of this invention to provide a connector device in which when mounting an inner plate into a casing, the biting of wires, as well as deformation and damage of a retaining portion, is prevented.

According to the present invention, there is provided a connector device comprising: an inner plate having a retaining portion and a terminal insertion portion, a connection terminal being mounted in the terminal insertion portion; and a casing in which the inner plate is mounted, the casing having a retaining projection formed therein, the retaining projection engaging with the retaining portion to retain the inner plate within the casing; wherein the retaining portion is formed so as to extend perallel to the terminal insertion portion, so that a wire connected to the connection terminal is extended outwardly regardless of the retaining portion.

The retaining portion may comprise: elongate support members spaced a predetermined distance from each other and extending parallel to the terminal insertion portion, an elastic engagement piece portion interconnecting one ends of the support members and adapted to be elastically engaged with the retaining projection.

Further, the inner plate may have a plurality of terminal insertion portions separated from each other by a plurality of partition walls formed on the inner plate.

Furthermore, the retaining portion may further comprise: reinforcement ribs connecting the support members respectively to the associated partition walls.

In the connector device of the above construction according to the present invention, the retaining portion is provided parallel to the terminal insertion portions each having the connection terminal mounted therein, and the elongate support members of the retaining portion are reinforced by the reinforcement ribs. Therefore, the support members have a suitable degree of rigidity, and the elastic engagement piece portion, interconnecting one ends of the support members has a suitable degree of elasticity so as to be deformed, and can be restored into its original shape.

Thus, the support members are provided parallel to the terminal insertion portions, and therefore wires, connected respectively to the connection terminals, are extended outwardly regardless of the retaining portion. Therefore, the biting of the wires and so on are positively prevented, and a good clicking sense can be obtained since the support members and the elastic engagement piece portion are suitably elastic. And besides, the support members and the elastic engagement piece portion are increased in strength by the reinforcement ribs, and therefore are positively prevented from damage and deformation.

DETAILED DESCRIPTION OF THE PREFERRED EMBODIMENTS

Figure 1:
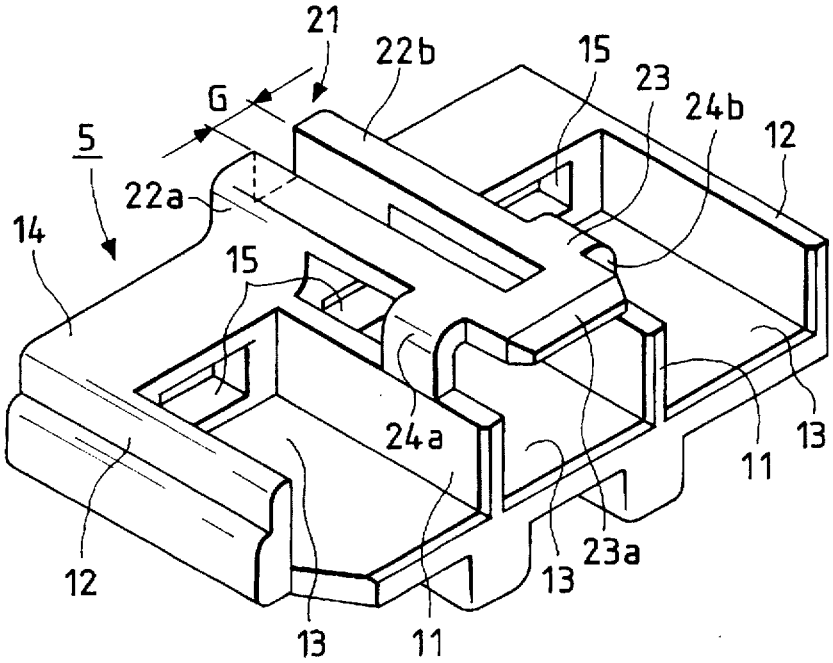
FIG. 1 is a perspective view of an inner plate of a connector device of the present invention.
Figure 2:
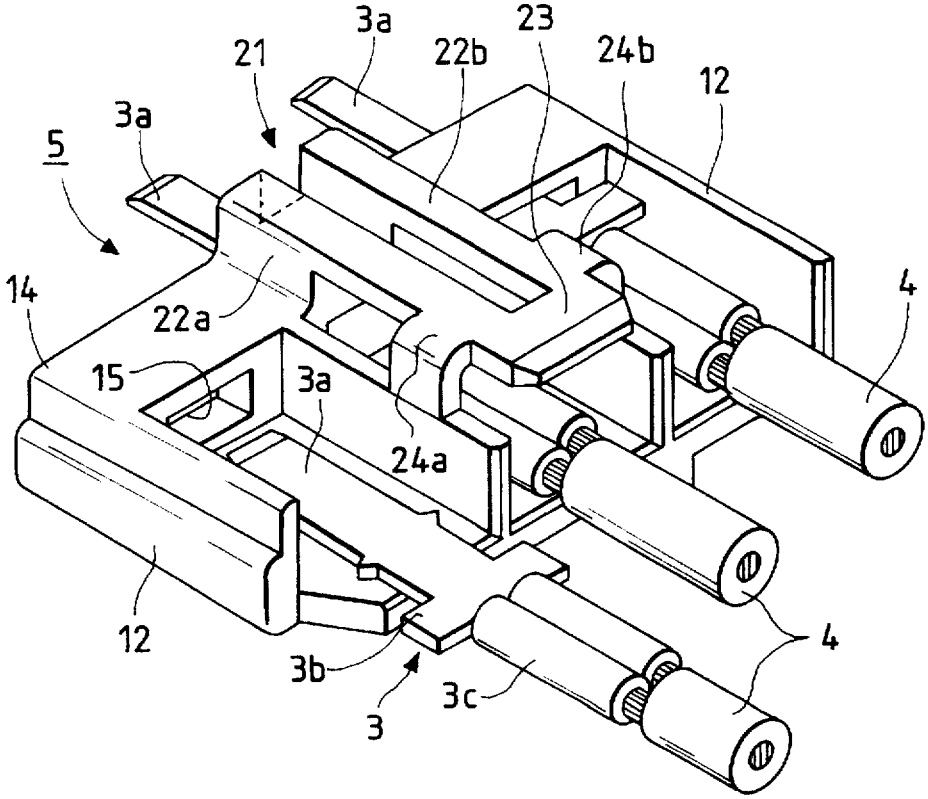
FIG. 2 is a perspective view of the inner plate having connection terminals mounted thereon.
Figure 3:
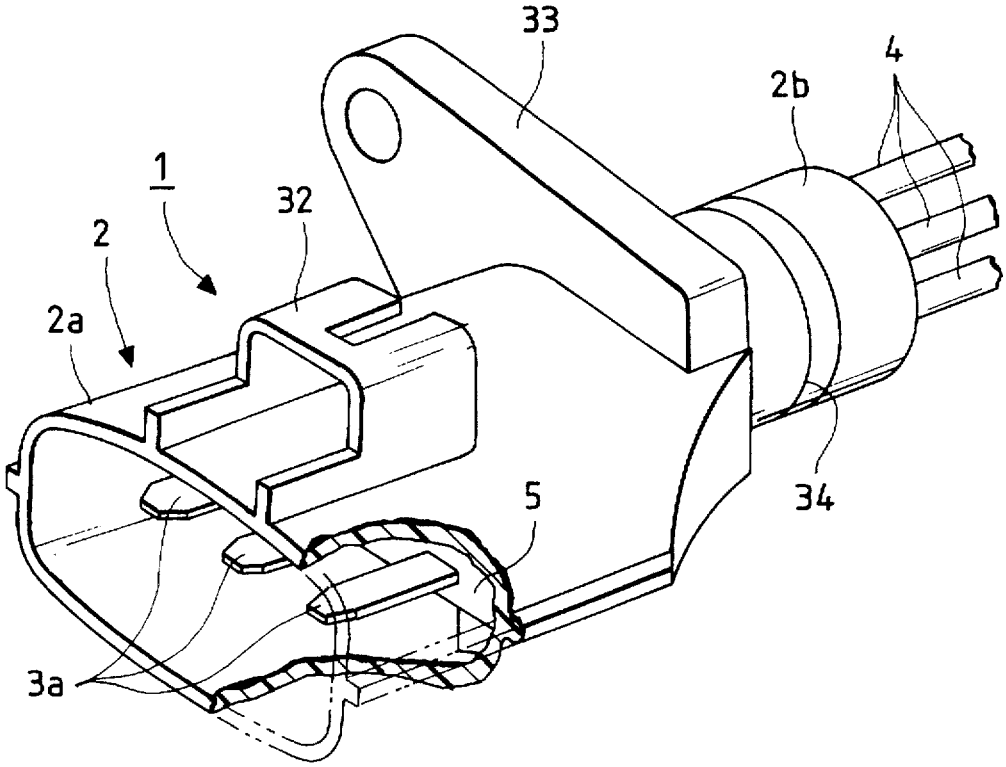
FIG. 3 is a partly-broken, perspective view of the connector device.

A preferred embodiment of a connector device of the present invention will now be described with reference to FIGS. 1 to 4. FIG. 1 is a perspective view of an inner plate of the connector device, FIG. 2 is a perspective view of the inner plate having connection terminals mounted thereon. FIG. 3 is a partly-broken, perspective view of the connector device, and FIG. 4 is a cross-sectional view of the connector device.

Figure 4:
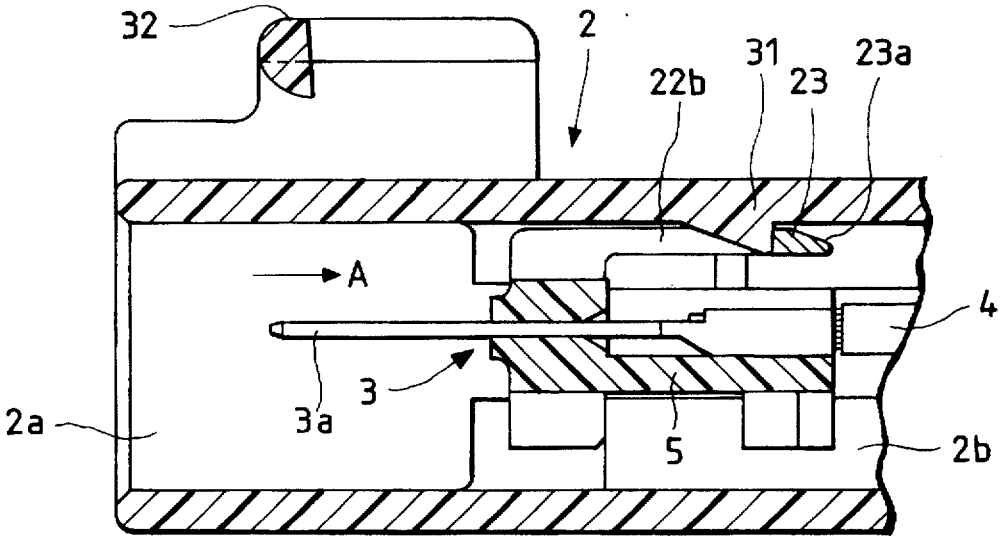
FIG. 4 is a cross-sectional view of the connector device shown in FIG. 3.
Figure 5:
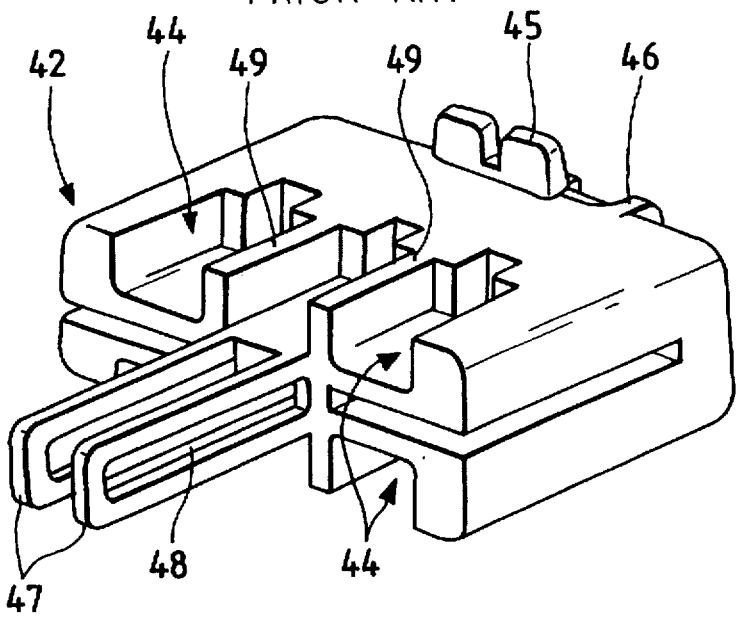
FIG. 5 PRIOR ART
FIG. 5 is a perspective view of a conventional inner plate.
Figure 6:
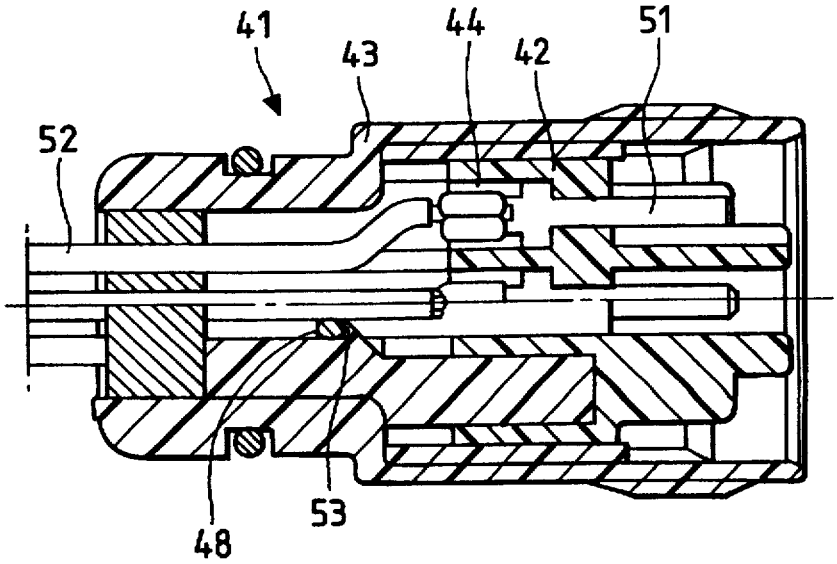
FIG. 6 PRIOR ART
FIG. 6 is a cross-sectional view showing an important portion of a conventional connector device.

The connector device 1 shown in FIGS. 3 and 4 comprises the inner plate 5 having the male connector terminals 3 (each clamped to an end of an associated wire 4) mounted therein, and the casing 2 of a tubular shape. The inner plate 5 is inserted into the casing 2 to be generally integrally connected thereto.

As shown in FIG. 1, the inner plate 5 is integrally molded of a synthetic resin, and has three terminal insertion portions 13 which are formed by inner partition walls 11 and outer side walls 12. A base portion 14 is formed at front ends of the terminal insertion portions 13, and terminal insertion holes 15 are formed through this base portion 14, and communicate with the terminal insertion portions 13, respectively.

The terminal insertion portions 13 have an open top, and a retaining portion 21 overlies the central terminal insertion portion 13 to cover the upper side thereof. This retaining portion 21 serves to releasably retain the inner plate 5 on the casing 2.

The retaining portion 21 comprises a pair of elongate support members 22*a* and 22*b* which are connected at their proximal ends to the base portion 14, and are spaced a predetermined distance G from each other, an elastic engagement piece portion 23 interconnecting distal ends of the support members 22*a* and 22*b*, and reinforcement ribs 24*a* and 24*b* which connect the support members 22*a* and 22*b* to the inner partition walls 11, respectively.

As shown in FIG. 2, each of the male connection terminals 3 has a connection portion 3*a* to be connected to a mating female connection terminal in a mating connector device, a flange portion 3*b* for retaining and positioning, and a clamping portion 3*c* clamping a conductor of the wire 4 at the end portion thereof from which a sheath has been removed.

As shown in FIG. 3, the casing 2 has a tubular body of a generally oval transverse cross-section, and when attaching the inner plate 5, having the connection terminals 3 mounted therein, to the casing 2, the inner plate 5 is inserted into a larger-diameter portion 2*a* of the casing 2 toward a smaller-diameter portion 2*b* thereof. A retaining portion 32 for retaining engagement with the mating connector, as well as a fixing portion 33 for being fixed to a device or an equipment to which the connector device 1 applied, is formed on an outer surface of the larger-diameter portion 2*a*, and a fitting groove 34 for receiving a rubber ring is formed in an outer surface of the smaller-diameter portion 2*b*.

And as shown in FIG. 4, a retaining projection 31 is formed in the casing 2, so that when the inner plate 5 is inserted in a direction of arrow A, the retaining projection 31 engages with the elastic engagement piece portion 23.

For assembling the connector device 1 of the above construction, the male connection terminals 3 each clamped to the end portion of the associated wire 4 are inserted respectively into the terminal insertion portions 13 from the rear side of the inner plate 5, as shown in FIG. 2. As a result, the connection terminals 3 are fixed with their connection portions (front end portions) 3*a* projected respectively from the terminal insertion holes 15.

Then, the inner plate 5 is inserted into the casing 2 in the direction of arrow A (FIG. 4), and the inner plate 5 is further pushed into the casing 2, or the wires 4 are pulled, so that the elastic engagement piece portion 23 passes past a retaining projection 31 formed on the casing 2, and as a result the inner plate 5 is retained within the casing 2. More specifically, when the elastic engagement piece portion 23 passes past the retaining projection 31 with the result that the retaining projection 31 is engaged in the gap G, the elastic engagement piece portion 23 is restored because of its own elasticity, and therefore the inner plate 5 is mounted in the casing against withdrawal. At this time, the elastic engagement piece portion 23 is elastically deformed downward and upward in such a manner that those portions in the vicinity of the areas of connection of this portion 23 to the reinforcement ribs 24*a* and 24*b* serve as a fulcrum, and therefore a good clicking sense can be obtained. A tapering surface 23*a* is formed at the distal end of the elastic engagement piece portion 23 so that it can smoothly pass past the retaining projection 23.

In this assembled condition, the connection portions 3*a* of the connection terminals 3 are projected into the larger-diameter portion 2*a*, and the wires 4 are extended outwardly from the connector device 1 through the smaller-diameter portion 2*b*, as shown in FIGS. 3 and 4. For connecting this connector device 1 to the mating connector, the mating connector is inserted into the larger-diameter portion 2*a*, so that the terminal portions 3*a* are fitted respectively into the female connection terminals in the mating connector.

As described above, in the connector device 1, the retaining portion 21 is provided to extend along the terminal insertion portion 13, and is not provided over any area disposed on a line of extension of the terminal insertion portion 13. Therefore, the wires 4 are extended outwardly from the terminal insertion portions 13, respectively, and the wires 4 will not be bitten and will not be entangled with each other. The support members 22*a* and 22*b* and the elastic engagement piece portion 23 have an appropriate degree of elasticity, and therefore a good clicking sense can be obtained. The support members 22*a* and 22*b* and the elastic engagement piece portion 23 are increased in strength by the reinforcement ribs 24*a* and 24*b*, and therefore are positively prevented from damage and deformation.

As described above, in the connector device of the present invention, the inner plate includes the retaining portion which comprises the elongate support members spaced a predetermined distance from each other and extending parallel to the terminal insertion portions, the elastic engagement piece portion interconnecting one ends of the support members and adapted to be elastically engaged with the retaining projection formed within the casing, and the reinforcement ribs connecting the support members respectively to the associated partition walls.

Therefore, when inserting the inner plate into the casing, the wires will not be bitten by the members of the retaining portion, and therefore the efficiency of the assembling operation is enhanced. The support members and the elastic engagement piece portion are increased in strength by the reinforcement ribs, and therefore are prevented from undesirable deformation and damage, and this enhances the reliability of the product, and also enhances the lock feeling obtained at the time of the assembling operation.

What is claimed is:

1. A connector device comprising:

an inner plate comprising:

a base portion having terminal insertion holes;

a terminal insertion portion adjacent to said base portion and communicated with said base portion through terminal insertion holes, said terminal insertion portion having a connector terminal mounted thereon; and a retaining portion disposed on both said base portion and said terminal insertion portion;

a casing in which said inner plate is mounted, said casing having a retaining projection formed therein and disposed above said retaining portion, said retaining projection engaging with said retaining portion to releasably retain said inner plate within said casing;

wherein said retaining portion is formed so as to extend parallel to said terminal insertion portion.

2. The connector device according to claim 1, wherein said retaining portion comprises: elongate support members spaced a predetermined distance from each other and extending parallel to said terminal insertion portion, an elastic engagement piece portion interconnecting one ends of said support members and adapted to be elastically engaged with said retaining projection.

3. The connector device according to claim 2, wherein a tapering surface is formed at a distal end of said elastic engagement piece portion.

4. The connector device according to claim 2, wherein a base portion having a terminal insertion hole is formed at a front end of said terminal insertion portion, and said elongate support members are connected at proximal ends thereof to said base portion.

5. The connector device according to claim 2, wherein said inner plate has a plurality of terminal insertion portions separated from each other by a plurality of partition walls formed on said inner plate.

6. The connector device according to claim 5, wherein said retaining portion further comprises: reinforcement ribs connecting said support members respectively to said associated partition walls.

* * * * *